US008714671B2

(12) United States Patent
Huang

(10) Patent No.: US 8,714,671 B2
(45) Date of Patent: May 6, 2014

(54) AUTOMATIC HOMING AND TRACK BUFFERING DEVICE

(75) Inventor: Kuo-Sheng Huang, New Taipei (TW)

(73) Assignee: Nan Juen International Co., Ltd., New Taipei (TW)

( * ) Notice: Subject to any disclaimer, the term of this patent is extended or adjusted under 35 U.S.C. 154(b) by 0 days.

(21) Appl. No.: 13/605,398

(22) Filed: Sep. 6, 2012

(65) Prior Publication Data

US 2013/0182978 A1 Jul. 18, 2013

(30) Foreign Application Priority Data

Jan. 12, 2012 (TW) ..... 101200746

(51) Int. Cl.
*A47B 95/00* (2006.01)

(52) U.S. Cl.
USPC ..... 312/333; 312/319.2

(58) Field of Classification Search
USPC ..... 312/319.1–319.2, 333, 334.6–334.8
See application file for complete search history.

(56) References Cited

U.S. PATENT DOCUMENTS

| | | | | |
|---|---|---|---|---|
| 7,077,487 | B2 * | 7/2006 | Yang | 312/333 |
| 7,533,946 | B2 * | 5/2009 | Hoffman | 312/333 |
| 7,854,485 | B2 * | 12/2010 | Berger | 312/333 |
| 8,011,743 | B2 * | 9/2011 | Nussbaumer et al. | 312/333 |
| 8,182,054 | B2 * | 5/2012 | Liang et al. | 312/333 |
| 8,235,478 | B2 * | 8/2012 | Zimmer et al. | 312/333 |
| 8,240,787 | B2 * | 8/2012 | Chen et al. | 312/333 |
| 8,240,788 | B2 * | 8/2012 | Juan et al. | 312/333 |
| 8,256,853 | B2 * | 9/2012 | Chen et al. | 312/333 |
| 8,282,177 | B1 * | 10/2012 | Rotter | 312/402 |
| 8,393,693 | B2 * | 3/2013 | Juan et al. | 312/333 |
| 8,414,094 | B2 * | 4/2013 | Chi et al. | 312/333 |
| 8,459,758 | B2 * | 6/2013 | Rechberg et al. | 312/333 |
| 2004/0183411 | A1 * | 9/2004 | Boks | 312/333 |
| 2004/0212283 | A1 * | 10/2004 | Gasser | 312/333 |
| 2007/0132346 | A1 * | 6/2007 | Huang | 312/333 |
| 2007/0278919 | A1 * | 12/2007 | Lu | 312/333 |
| 2010/0026152 | A1 * | 2/2010 | Huang | 312/319.1 |
| 2010/0123378 | A1 * | 5/2010 | Chen et al. | 312/333 |

FOREIGN PATENT DOCUMENTS

TW 201118274 A 6/2011

* cited by examiner

*Primary Examiner* — Hanh V Tran
(74) *Attorney, Agent, or Firm* — Muncy, Geissler, Olds & Lowe, P.C.

(57) ABSTRACT

The present invention provides an automatic homing and track buffering device comprising a buffer base in which there are (a) a main base body with a buffer groove space and a flexible groove space prepared at both sides, a slide margin, and a revolving-resistant member having a slip resisting wall and a revolving-resistant wall in succession; (b) a buffer member; (c) a flexible member; (d) a swing member linking the buffer member's and the flexible member's front ends and provided with a push arm and a draw arm for development of an operating space in between wherein the draw arm has a first slider (external side) and a second slider with a curved part (internal side) for development of a slide groove in between.

11 Claims, 5 Drawing Sheets

10
70
241
24
71
23
14
50

53
52
71
20
14
23
25
241
24
10
50
51
53
70
60

AUTOMATIC HOMING AND TRACK BUFFERING DEVICE

BACKGROUND OF THE INVENTION

1. Field of the Invention

The present invention relates to a buffering structure, particularly an automatic homing and track buffering device used in conjunction with slide tracks and featuring a compact structure which is of service to manufacture and assembly, minimizes failures, and realizes superior smooth operations and buffering effect.

2. Description of the Related Art

Cabinet lockers or drawers have been extensively applied in various storage implements. To realize a cabinet locker (drawer) which is conveniently pulled out, those slide tracks with functions for positioning and guidance are usually integrated into both laterals of a cabinet locker (drawer). For stable and quiet close of a cabinet locker (drawer), the slide tracks are further integrated with a buffering mechanism which takes advantage of a buffer action to prevent the cabinet from strong collision or noise and keep its longer service life and better operational quality. As shown in the disclosed patent for a track buffering mechanism (Patent No. 201118274), the slide track homing structure comprises a fixed track 1 securely held in a cabinet body, an extensible track 3 assembled in the fixed track 1, and a homing unit 300. The features of a slide action of the extensible track 3 relative to the fixed track 1 are: the homing unit 300 which is assembled to the fixed track 1 or in a drawer with the fixed track 1 and the extensible track 3 integrated and parallel to the extensible track 3 comprises (a) a guide member 8 mounted on the extensible track 3 or the fixed track 1; (b) a fixed member 4 installed on the fixed track 1; (c) a sliding track 5 consisting of a through wall 12 and a closed wall 11 parallel to each other and a planar structure 10, installed at one end of the fixed member 4, and designed to have a first resisting track 13, a second resisting track 14 and two corresponding fastening grooves 15 at the two resisting tracks' front ends; (d) a slide member 20 linking the sliding track 5 and provided with a spindle part 21; (e) a fastening member 30 provided with a first resisting member 33, a second resisting member 34 and a rotating part 31 wherein the rotating part 31 links the spindle part 21 of the slide member 20, the first resisting member 33 is installed in front of the second resisting member 34, and the fastening member 30 corresponds to and is coupled with the guide member 8; (f) at least a flexible member 6 installed between the slide member 20 and the fixed member 4 (or the fixed track 1). On the sliding track 5, the first resisting track 13 and the second resisting track 14 correspond to the first resisting member 33 and the second resisting member 34 of the fastening member 30, respectively; the two resisting tracks 13, 14 are installed at both sides of the rotating part 31 of the fastening member 30. For the track homing structure in a homing mode, the fastening member 30 is against the sliding track 5 under a resilient force out of the flexible member 6; for the track homing structure which has been fastened, the fastening member 30 pulled by the extensible track 3 arrives at the fastening groove 15 and turns to be fixed in the fastening groove 15.

Based on prior arts, the track buffering structure which meets buffer homing still has some drawbacks, for instance, the homing structure (as shown in Patent Specification (FIGS. 13 and 14)) comprising a fixed member 4, a slide member 20, a fastening member 30, and two flexible members 6 has a complicated structure which encourages manufacture and assembly costs without economic efficiency, complicates components, and deteriorates the failure rate and is regarded as an ideal design. Furthermore, the track buffering structure relies on the deflected fastening member 30 to realize positioning, that is, the fastening member 30 under a tensile force deflects at two fastening grooves 15 but its positioning and deflection effect is unstable because the fastening groove 15 which must match but be restricted by the corresponding first resisting track 13 frequently results in the fastening member 30 pulled by the flexible member 6 and failure of buffer homing in case of accidental collision or strike.

Against this background, it is necessary to correct or overcome above drawbacks of the prior buffering structure by the persons skilled in the arts.

Accordingly, the inventor having considered imperfection of the prior buffering structure in manufacture, assembly, employment and structural design and attempted to optimize an automatic homing and track buffering device with features such as smoothness, stability and durability has studied and developed a solution for serving the general public and promoting development of the industry.

SUMMARY OF THE INVENTION

The object of the present invention is to provide an automatic homing and track buffering device with characteristics such as a compact structure and a convenient, quick and economic manufacture or assembly procedure positively promoting economic efficiency of manufacture and assembly.

The other object of the present invention is to provide an automatic homing and track buffering device with characteristics such as superior smooth, stable and qualified buffer action, minimized troubles and reliable durability in a homing buffer operation, promoted practicability, and product competitiveness.

To achieve the above purposes, the present invention depends on a technical measure comprising a buffer base which is provided with the following components: a main base body with a buffer groove space and a flexible groove space prepared at both sides; a slide margin extending forward from the main base body's lateral margin; a slide terminal developed at the slide margin's front end; a revolving-resistant member which is located at the main base body's front end and opposite to the slide terminal and comprises a straight slide resisting wall being contrary to the slide margin and continuously linking a curved revolving-resistant wall ahead; a buffer member held in the buffer groove space; a flexible member held in the flexible groove space; a swing member linking the buffer member's and the flexible member's front ends and equipped with (a) a push arm opposite to the slide margin and a draw arm at the push arm's front end for development of an operating space in between, (b) a first slider (external side) and a second slider (internal slid) at the draw arm's bottom for development of a slide groove in between wherein the slide groove is held in the slide margin and the second slider has a curved part at the rear end.

For technical features and effects in terms of the present disclosure completely understood and recognized, the preferred embodiments and detailed drawings are described hereinafter.

BRIEF DESCRIPTION OF THE DRAWINGS

FIG. 4A is a partial enlargement view of FIG. 4.

DETAILED DESCRIPTION OF THE PREFERRED EMBODIMENTS

Figures 1, 1A:
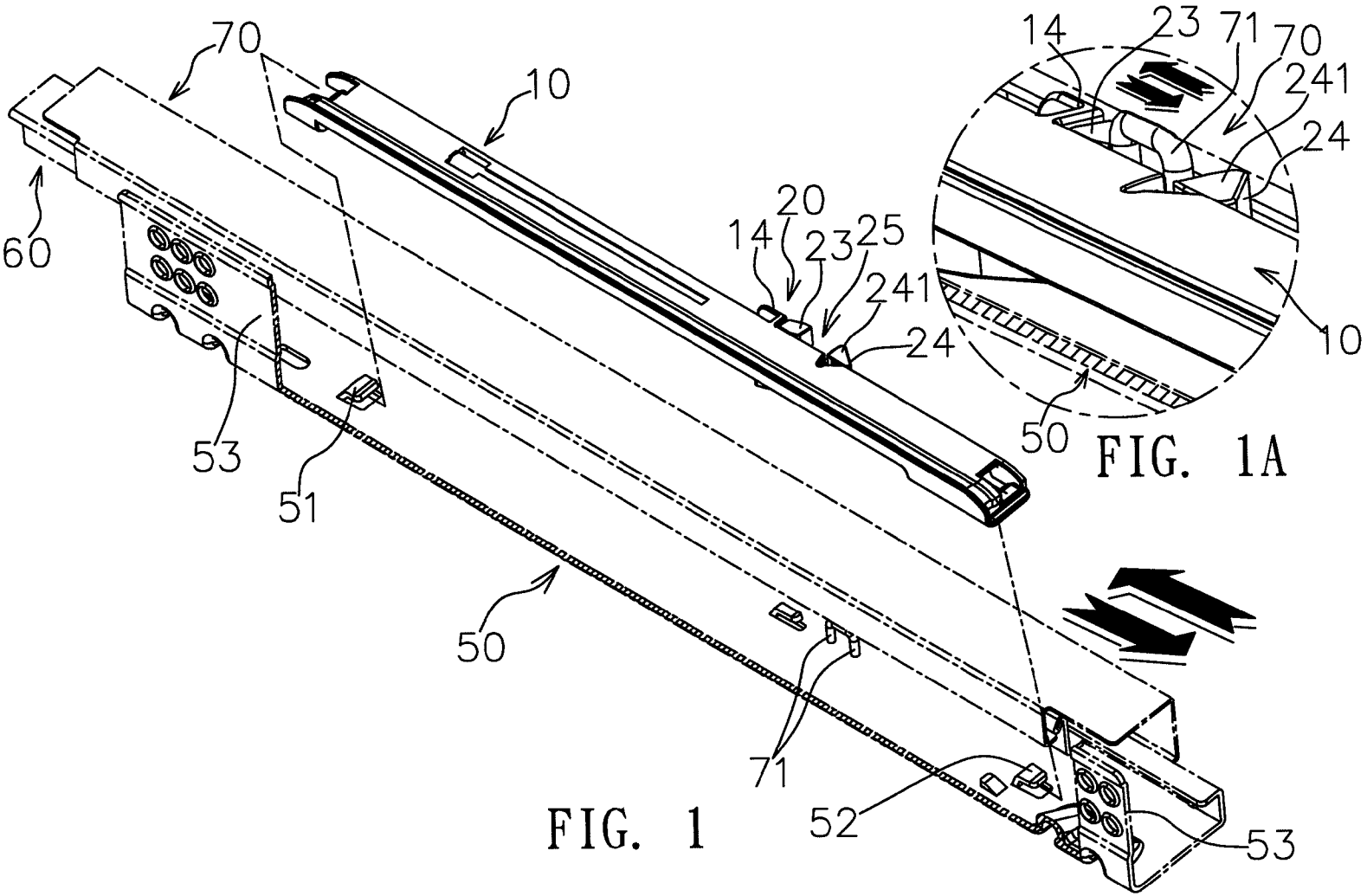
FIG. 1 is a partial schematic view of the present invention.
FIG. 1A is a partial enlargement view of FIG. 1.
Figure 2:
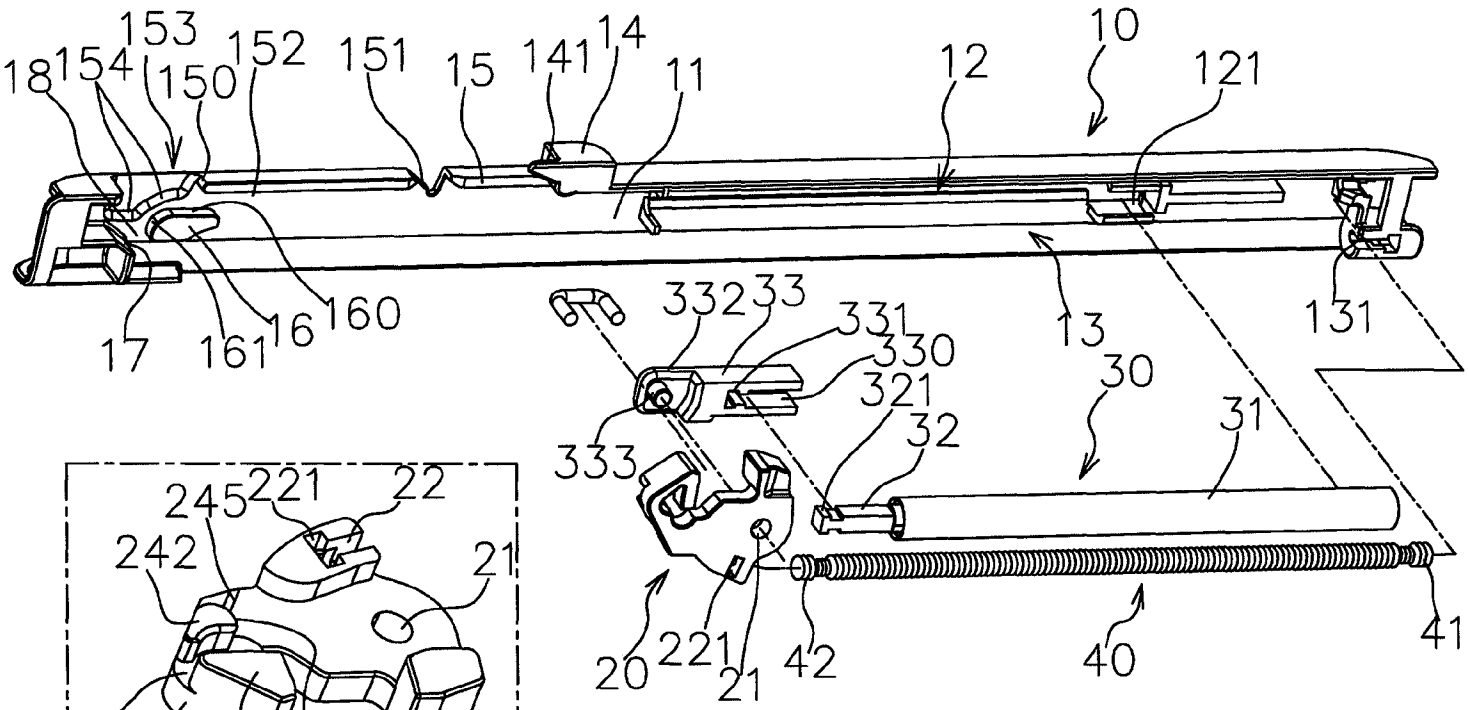
FIG. 2 is an exploded schematic view of the present invention.
Figure 2A:
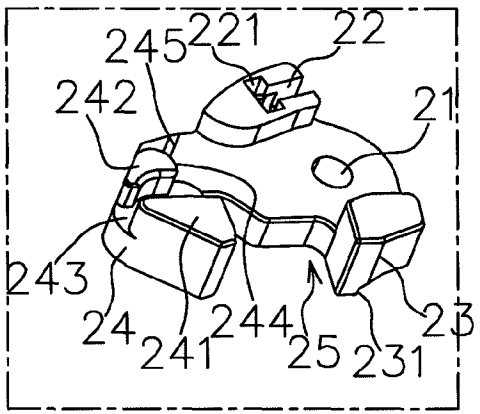
FIG. 2A is a schematic view of the swing member in the present invention observed from another angle.

Referring to FIGS. 1, 1A, 2 and 2A which illustrate the present invention of an automatic homing and track buffering device comprises a buffer base 10, a swing member 20, a buffer member 30 and a flexible member 40. The buffer base 10 comprises a long tabular main base body 11 with a buffer groove space 12 and a flexible groove space 13 prepared at both sides wherein the buffer groove space 12 and the flexible groove space 13 are provided with a locating seat 121 and a locating part 131 at their rear ends, respectively. A positioning stopper 14 with a raised resisting part 141 protruding forward is mounted on the main base body 11 and opposite to one lateral edge of the buffer groove space 12. A slide margin 15 extends forward from the positioning stopper 14 at a lateral margin of the main base body 11 for further development of a marginal notch 151 and a marginal recess 152 wherein the marginal recess 152 has a slide terminal 150 developed ahead as a terminal of the extending-forward slide margin 15. A revolving-oriented groove 153 (ahead) and a revolving-resistant member 16 (back) obliquely opposite each other are designed in front of the slide terminal 150 of the main base body 11: the revolving-oriented groove 153 is provided with a resistive groove wall 154 inward beveled and concave which is developed to be a curved or straight concave wall; the revolving-resistant member 16 as one bulge is provided with a straight slip resisting wall 160 being opposite to the slide margin 15 and continuously linking a curved revolving-resistant wall 161 ahead. Furthermore, the main base body 11 is equipped with a beveled resisting plane 17 which is located in the front of the main base body 11 and opposite to the revolving-oriented groove 153; the beveled resisting plane 17 and the revolving-resistant member 16 is separated by a retracted space 18 which is contrary to the revolving-oriented groove 153.

The swing member 20 is designed to have a joint hole 21 and a through groove 22 on which there is a vertical fastening groove 221 at the terminal. The swing member 20 is also designed to have a push arm 23, which is located at the other side and opposite to the through groove 22, and a draw arm 24 in the front of and opposite to the push arm 23 for an operating space 25 developed between the push arm 23 and the draw arm 24. Furthermore, a resisting groove 231 is opened at the top of the push arm 23. The draw arm 24 developed as a curved bar has a first slider 241 (external side) and a second slider 242 (internal side), which has a smaller depth (thickness) than the first slider 241, at the bottom (FIG. 2A) for development of a slide groove 243 in between. Furthermore, the second slider 242 has a curved part 244 at the rear end and a retracted concave plane 245 in the back of the second slider 242 for both the retracted concave plane 245 and the slide groove 243 on the same plane approximately.

The buffer member 30 comprises a buffer casing 31, i.e., a cannular tube in which a buffer stick 32 is held, wherein the buffer stick 32 is able to extrude from the buffer casing 31 and has a tip tenon 321 with grooves opened. The buffer member 30 further comprises a joint member 33 with an open channel 330 designed at the rear end and further linking a rabbet 331 ahead wherein the rabbet 331 and the open channel 330, which are coupled with the tip tenon 321 and the buffer stick 32 respectively, allow the joint member 33 to engage the buffer member 30 (buffer stick 32) at its front end. The joint member 33 is designed to have a thinner front joint part 332 on which a joint head 333 is provided. In this embodiment, the flexible member 40 is one spring with engagement parts 41, 42 at its front and rear ends.

Figure 3A:
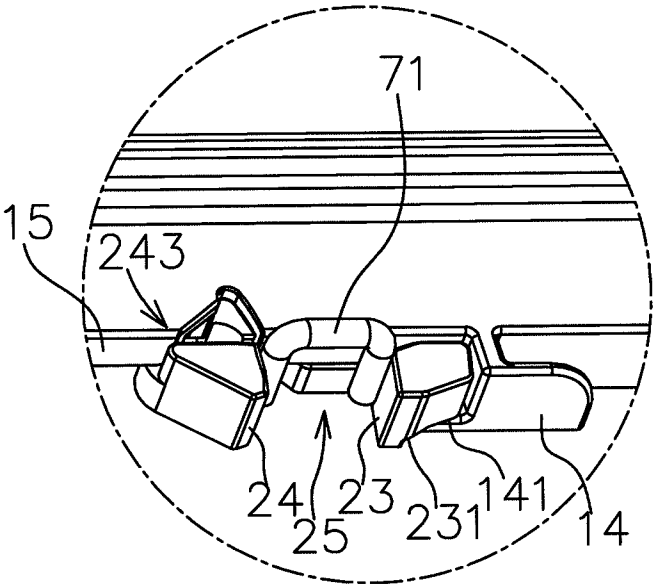
FIG. 3A is a partial enlargement view of FIG. 3.
Figure 3:
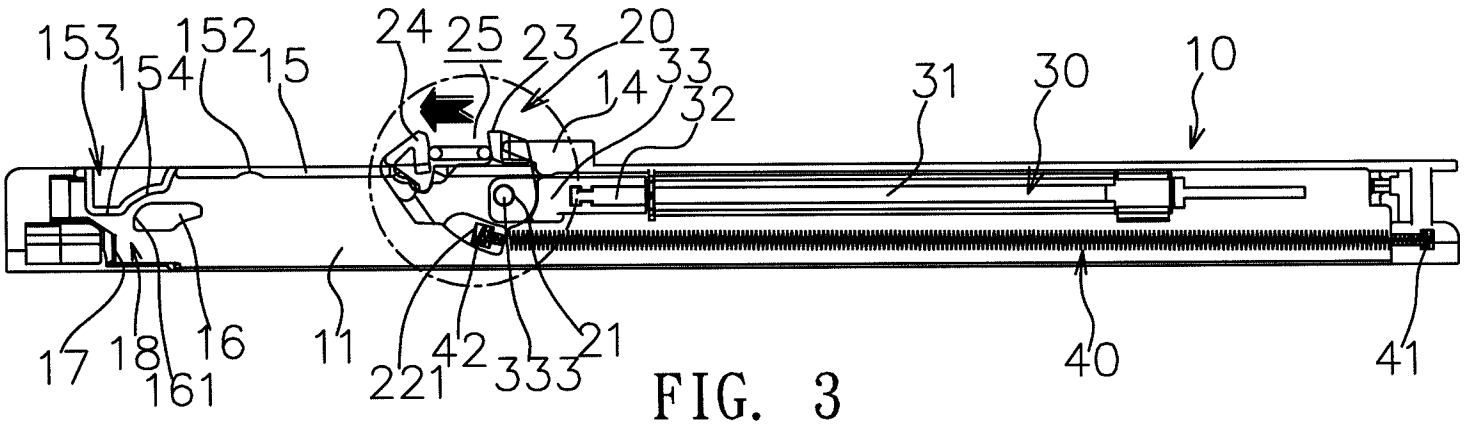
FIG. 3 is a schematic view of the present invention which has been assembled.

Referring to FIGS. 3 and 3A which illustrate the present invention of an assembled automatic homing and track buffering device with the rear end of the buffer member 30 (buffer casing 31) securely linking the locating seat 121 of the main base body 11 allows the buffer member 30 to be fixed in the buffer groove space 12. Moreover, the flexible member 40 can be positioned in the flexible groove space 13 and link the swing member 20 when the engagement part 41 and the engagement part 42 are embedded into the locating part 131 of the main base body 11 and the fastening groove 221 of the swing member 20, respectively.

Then, the joint hole 21 on the swing member 20 engages the joint head 333 of the buffer member 30 (joint member 33) in order to make the swing member 20 link the buffer member 30. Furthermore, the slide groove 243 on the swing member 20 is next to the slide margin 15 of the main base body 11 so that the resisting groove 231 of the push arm 23 under haul of the flexible member 40 contacts the raised resisting part 141 of the positioning stopper 14 to complete a joint operation.

As shown in FIGS. 1 and 1A, the buffer base 10 has its both ends connected between two fixed retainers 51, 52 of a bottom track 50 and is positioned on the bottom track 50; the bottom track 50 relies on its lateral mounted plate 53 to be fixed on a cabinet wall (not shown in figures) and is equipped with a central track 60 on which an external track 70 slides. The external track 70 is provided with a push member 71, an inverse U-shaped member contrary to the swing member 20 in this embodiment, which is used to drive the swing member 20 and is held in the operating space 25 of the swing member 20 while assembled and ready to be operated without limitation of its shape.

Figure 4:
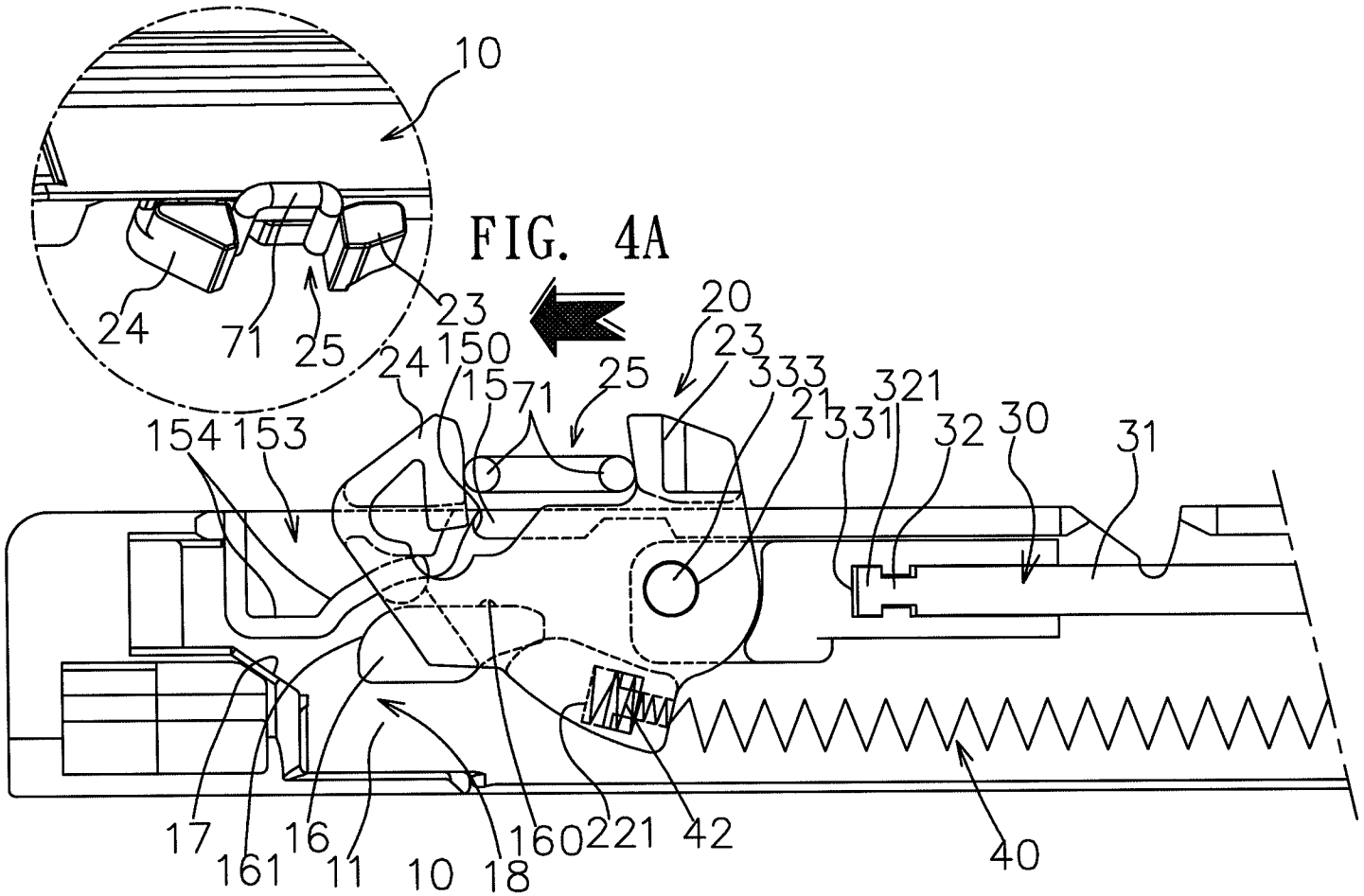
FIG. 4 is a schematic view of the present invention in use.
Figures 5, 5A:
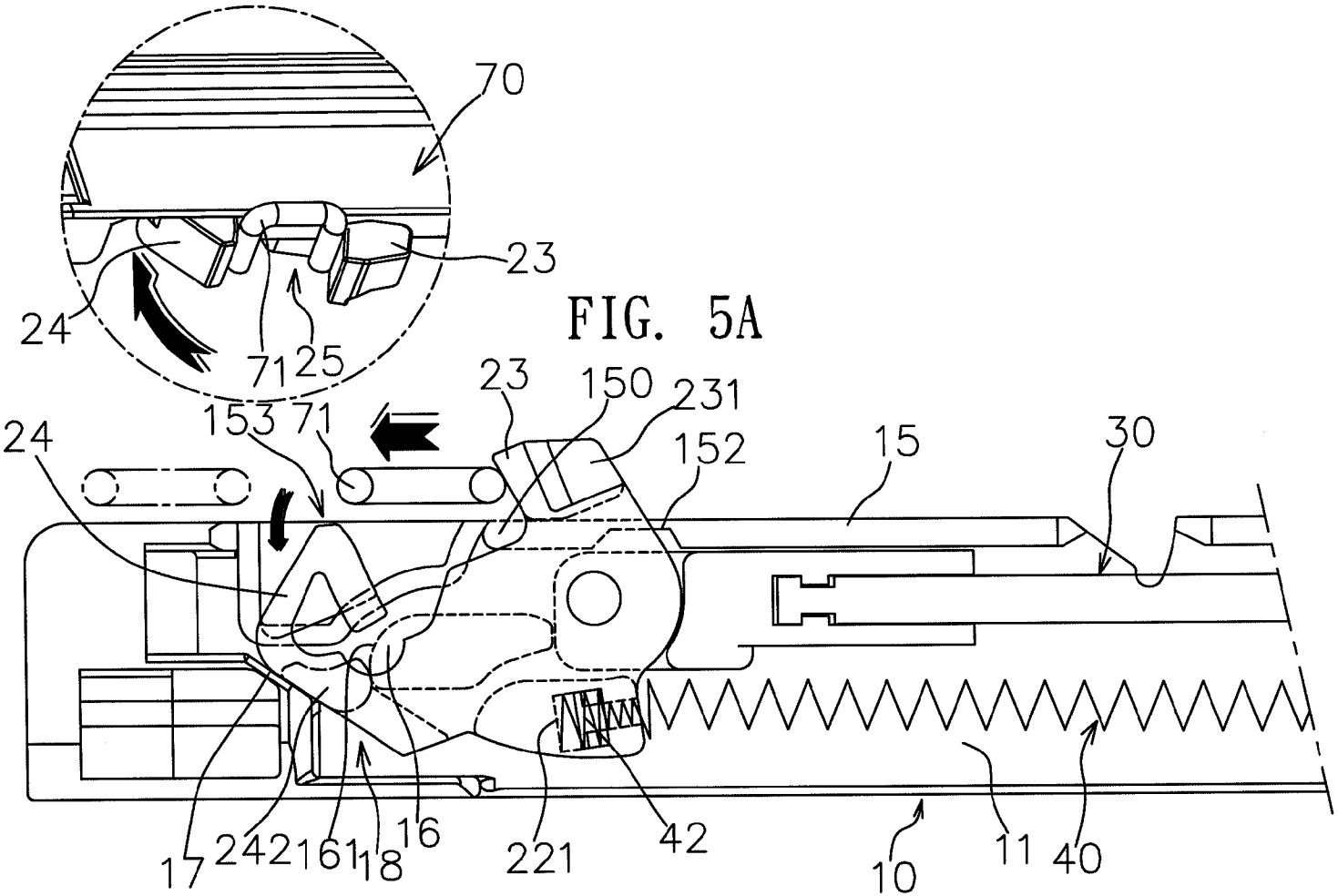
FIG. 5 is an alternative schematic view of the present invention in use.
FIG. 5A is a partial enlargement view of FIG. 5.

Referring to FIGS. 4, 5, and 5A which illustrate the present invention of an automatic homing and track buffering device in use. The swing member 20 goes forward in conjunction with the draw arm 24 of the swing member 20 which is driven by the push member 71 when the external track 70 is drawn onward (for instance, a cabinet body is drawn out). Meanwhile, the swing member 20 which relies on the slide groove 243 slides forward along the slide margin 15 of the main base body 11 and drives both the buffer member 30 and the flexible member 40 to move simultaneously. The second slider 242 of the swing member 20 which arrives at the slide terminal 150 will be deflected along the slip resisting wall 160 and the revolving-resistant wall 161 on the revolving-resistant member 16 under effect of both a forward tensile force of the external track 70 and a lateral tensile force of the flexible member 40. When the first slider 241 of the deflected swing member 20 enters into the revolving-oriented groove 153, the push member 71 still moves forward and out of the operating space 25 but does not haul the draw arm 24 in virtue of the deflected swing member 20 and the ongoing external track 70. As shown in FIGS. 5 and 5A, the second slider 242 of the swing member 20 under effect of a lateral tensile force continuously applied by the flexible member 40 is restrained and positioned at the beveled resisting plane 17 and the revolving-resistant wall 161 of the revolving-resistant member 16; the first slider 241 contacts the resistive groove wall 154 and makes the swing member 20 positioned temporarily.

Furthermore, in virtue of the marginal recess 152 on the slide margin 15, the bottom corner of push arm 23 on the deflected swing member 20 enters into the marginal recess 152, promoting a deflected angle and post-deflection stability of the swing member 20, that is, relatively better stability, precision and operational quality.

The push member 71 which passes through the draw arm 24 and enters into the operating space 25 during backward movement of the external track 70 (e.g., a cabinet body pushed back) continues its movement, driving the push arm 23 and resuming the initial state of the swing member 20. As such, the slide groove 243 of the swing member 20 corresponds to the slide margin 15 on the main base body 11 again, so as to complete the cabinet body's automatic homing procedure by hauling the swing member 20 and the external track 70 backward under effect of a resilient pull applied by the flexible member 40; meanwhile, the buffer member 30 exerts its buffer action to decelerate the cabinet body's automatic homing movement and prevent collision.

The present invention of an automatic homing and track buffering device depends on its technical formation to simplify the overall structure, realize convenient, quick and economic manufacture or assembly, positively promote economic efficiency in manufacture and assembly, and optimize a smooth, steady and qualified homing buffer operation with minimized troubles, excellent durability, practicability and product competitiveness.

It can be seen from the above descriptions that the present invention significantly meets patentability and is applied for the patent. However, the above descriptions present preferred embodiments only which do not limit the scope of the present invention; any equivalent change or improvement based on shapes, structures, features and spirit mentioned in the present invention should be incorporated in claims.

What is claimed is:

1. An automatic homing and track buffering device which for integration into a cabinet or a locker drawer, comprising:

a buffer base comprising a main base body with a buffer groove space and a flexible groove space prepared at both sides: said main base body has (a) a slide margin extending forward along a lateral margin, (b) a slide terminal developed in the front of said slide margin, and (c) a revolving-oriented groove is provided with a resistive groove wall inward beveled and concave which is developed to be a curved or straight concave wall, which revolving-oriented groove is obliquely opposite to a revolving-resistant member, a beveled resisting plane is located in the front of said main base body and opposite to said revolving-oriented groove and said beveled resisting plane as well as said revolving-resistant member are separated by a retracted space which is contrary to said revolving-oriented groove, (d) said revolving-resistant member, which is located at said main base body's front end and opposite to said slide terminal and has a straight slip resisting wall being opposite to the slide margin and continuously linking a curved revolving-resistant wall ahead;

a buffer member held in said buffer groove space, which buffer groove space has a locating seat designed at the rear end and used to position said buffer member;

a flexible member held in said flexible groove space, which flexible groove space has a locating seat designed at the rear end and used to position said flexible member;

a swing member jointing and linking the buffer member's and the flexible member's front ends separately and provided with a push arm which is opposite to said slide margin: (a) said push arm has a draw arm at the front end for development of an operating space between said push arm and said draw arm; (b) said draw arm is provided with a first slider on the external side as well as a second slider on the internal side at the bottom for development of a slide groove in between; (c) said slide groove is formed on the slide margin; (d) said second slider has a curved part at the rear end;

whereby, when a cabinet or a locker drawer body is drawn out, the second slider of the swing member which arrives at the slide terminal will be deflected along the slip resisting wall and the revolving-resistant wall on the revolving-resistant member under effect of both a forward tensile force of a cabinet or a locker drawer and a lateral tensile force of the flexible member, the first slider of the deflected swing member enters into the revolving-oriented groove, the second slider of the swing member under effect of a lateral tensile force continuously applied by the flexible member is restrained and positioned at the beveled resisting plane and the revolving-resistant wall of the revolving-resistant member; the first slider contacts the resistive groove wall and temporarily positions the swing member.

2. The automatic homing and track buffering device according to claim 1 wherein said main base body is provided with a positioning stopper which is opposite to one lateral edge of said buffer groove space and located at said slide margin's rear end and has a raised resisting part protruding forward and corresponding to a resisting groove at the top of said push arm.

3. The automatic homing and track buffering device according to claim 1 wherein said slide margin has a marginal recess at the front end.

4. The automatic homing and track buffering device according to claim 3 wherein said slide margin has a marginal notch in the back of said marginal recess.

5. The automatic homing and track buffering device according to claim 1 wherein said swing member is designed to have a joint hole.

6. The automatic homing and track buffering device according to claim 5 wherein a through groove which is arranged beside said joint hole comprises a vertical fastening groove at the terminal.

7. The automatic homing and track buffering device according to claim 1 wherein said first slider has a larger thickness than that of said second slider.

8. The automatic homing and track buffering device according to claim 1 wherein said buffer member comprises a buffer casing in which there is a buffer stick protruding from said buffer casing.

9. The automatic homing and track buffering device according to claim 8 wherein said buffer member further comprises a joint member with an open channel designed at the rear end and further linking a rabbet at the tip and said buffer stick has a tip tenon which is embedded in said rabbet.

10. The automatic homing and track buffering device according to claim 9 wherein said joint member is designed to have a thinner joint part on which a joint head is provided.

11. The automatic homing and track buffering device according to claim 1 wherein said buffer base is fixed on a bottom track on which an external track slides and said external track is provided with a push member, which is opposite to and drives said swing member, and further held inside said swing member's operating space during an idle condition; whereby, when a cabinet or a locker drawer body is pushed back, the push member passes through the draw arm and enters into the operating space, during backward movement of a cabinet or a locker drawer body, driving the push arm and resuming the initial state of the swing member, the slide groove of the swing member corresponds to the slide margin on the main base body, so as to complete the cabinet body's automatic homing procedure by hauling the swing member and the external track backward under effect of a resilient pull applied by the flexible member.

* * * * *